US008011871B2

(12) United States Patent
Lehrieder et al.

(10) Patent No.: US 8,011,871 B2
(45) Date of Patent: Sep. 6, 2011

(54) DEVICES FOR TRANSPORTING REELS OF MATERIAL

(75) Inventors: Erwin Paul Josef Lehrieder, Gaukönigshofen (DE); Josef Herbert Olbort, Mainbernheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 807 days.

(21) Appl. No.: 10/590,390

(22) PCT Filed: Feb. 9, 2005

(86) PCT No.: PCT/EP2005/050569

§ 371 (c)(1),
(2), (4) Date: Aug. 23, 2006

(87) PCT Pub. No.: WO2005/080241

PCT Pub. Date: Sep. 1, 2005

(65) Prior Publication Data

US 2007/0170298 A1 Jul. 26, 2007

(30) Foreign Application Priority Data

Feb. 23, 2004 (DE) ..... 10 2004 008 771
May 3, 2004 (DE) ..... 10 2004 021 605

(51) Int. Cl.
*B65H 37/00* (2006.01)
*B65G 1/133* (2006.01)

(52) U.S. Cl. ..... 414/279; 414/911; 242/559; 242/560

(58) Field of Classification Search ..... 242/559, 242/559.3, 560; 414/911, 277, 279
See application file for complete search history.

(56) References Cited

U.S. PATENT DOCUMENTS

| | | | | |
|---|---|---|---|---|
| 4,386,741 | A | 6/1983 | Weiss et al. | |
| 4,537,368 | A | 8/1985 | Radmore et al. | |
| 5,076,751 | A | 12/1991 | Kafka | |
| 5,085,377 | A | 2/1992 | Rohrer et al. | |
| 6,007,017 | A | 12/1999 | Vorwerk | |
| 6,039,284 | A | 3/2000 | Lehrieder et al. | |
| 6,138,938 | A | 10/2000 | Lehrieder et al. | |
| 6,155,516 | A | 12/2000 | Lehrieder et al. | |
| 2003/0071162 | A1 | 4/2003 | Moser | |
| 2003/0164102 | A1 * | 9/2003 | Schaede | 101/225 |

(Continued)

FOREIGN PATENT DOCUMENTS

DE 39 10 444 A1 10/1990

(Continued)

OTHER PUBLICATIONS

"Genau Anpassung Moglich, Zaun erhoht Sicherheit im Maschinenumfeld," Jan. 12, 1998, Betriebstechnik aktuell 39.

(Continued)

*Primary Examiner* — Saul J Rodriguez
*Assistant Examiner* — Jonathan D Snelting
(74) *Attorney, Agent, or Firm* — Jones, Tullar & Cooper, P.C.

(57) ABSTRACT

Reels of material are transported by being disposed on a first transport carriage which is, in turn, disposed on a second transport carriage. The second transport carriage travels between a reel storage area, that has a plurality of storage spaces, and a reel changer of a web-processing machine. The second transport carriage, together with the first transport carriage and the reel of material that is deposited on the first transport carriage then travels to an offload or unload position of the reel changer.

48 Claims, 8 Drawing Sheets

U.S. PATENT DOCUMENTS

| | | | | |
|---|---|---|---|---|
| 2004/0091340 | A1* | 5/2004 | Allemann | 414/281 |
| 2005/0166784 | A1 | 8/2005 | Lehrieder | |
| 2006/0000940 | A1 | 1/2006 | Frey et al. | |

FOREIGN PATENT DOCUMENTS

| | | | |
|---|---|---|---|
| DE | 41 35 001 | A1 | 6/1992 |
| DE | 295 16 155 | U1 | 1/1996 |
| DE | 196 26 866 | A1 | 6/1997 |
| DE | 37 39 222 | A1 | 5/1998 |
| DE | 102 45 220 | A1 | 6/2003 |
| DE | 203 07 581 | U1 | 10/2003 |
| DE | 20 2004 012 800 | | 12/2004 |
| EP | 0 925 246 | B1 | 9/1997 |
| EP | 1 044 912 | A1 | 9/1997 |
| EP | 0 849 201 | A1 | 12/1997 |
| EP | 1 329 397 | A1 | 1/2002 |
| GB | 2 382 340 | | 5/2003 |
| JP | 62-157160 | | 7/1987 |
| JP | 63-74852 | | 4/1988 |
| WO | WO 98/12133 | | 3/1998 |
| WO | WO 03/080484 | A1 | 10/2003 |

OTHER PUBLICATIONS

Contiweb B.V., a Netherlands company, material submitted on Jun. 18, 2010 to Herr Jürgen Stiel by Mr. Rutger Jansen: (1) bill of lading No. 359346, dated Feb. 4, 2004; (2) non-dated schematic drawing; and (3) non-dated black and white photograph. Also submitted: enlargement of legend portion of non-dated schematic drawing.

E-mail from Lex Bruggers to Jurgen Stiel, dated Feb. 4, 2011 (2 pp); two(2) sheets of drawings; Purchase Order Change, dated Feb. 25, 2004 (2 pp); and an Interfracht, dated Feb. 19, 2004 (1 p.). All of the above forwarded by e-mail from Jurgen Stiel to Douglas R. Hanscom on Feb. 11, 2001.

E-mail from Lex Bruggers to Jurgen Stiel, dated Feb. 11, 2011 (3 pp); two (2) sheets of drawings; enlargements of various sections of legends from drawing sheets (4 pp.); and "5 unit, 1 web Sunday 3000132, Exhibit A, Equipment Description", to The Arandell Corporation, Menomonee Falls, WI, dated Dec. 19, 2003 (1 p.). All of the above forwarded by e-mail from Jurgen Stiel to Duglas R. Hanscom on Feb. 11, 2011.

* cited by examiner

DEVICES FOR TRANSPORTING REELS OF MATERIAL

CROSS-REFERENCE TO RELATED APPLICATIONS

This patent application is the U.S. National Phase, under 35 USC 371, of PCT/EP2005/050569, filed Feb. 9, 2005; published as WO 2005/080241 A2 and A3 on Sep. 1, 2005, and claiming priority to DE 10 2004 008 771.7, filed Feb. 23, 2004 and to DE 10 2004 021 605.3, filed May 3, 2004, the disclosures of which are expressly incorporated herein by reference.

FIELD OF THE INVENTION

The present invention is directed to devices for transporting reels or rolls of material. The reels or rolls of material are stored in a storage area and are moved from the storage area to a web-processing machine on individual transport carriages.

BACKGROUND OF THE INVENTION

In web-processing machines, such as in web-fed rotary printing presses, so-called reel changers are provided and serve to supply material, such as, for example, a web of printing material, to the web-processing machine. During a reel change, the wound off or exhausted reel of material is removed from the reel changer and is replaced by a new reel of material. Various transport systems for use in transporting the new reels of material to the reel changer or for transporting the wound off reels of material away from the reel changer are known from the prior art.

In EP 0 925 246 B1 and in EP 0 925 248A, there is described a complex system for use in transporting reels of material to and from the reel changer of a printing machine. In this prior device, the reels of material are stored, on their circumferential surfaces, on first transport carriages. The actual conveyance of the reels of material is then accomplished by loading the first transport carriages onto second transport carriages. This means, in other words, that the first transport carriages are loaded, piggyback, onto the second transport carriages. In the system described in EP 0 925 246 B1, a total of four different sections of rails or track for the second transport carriages are provided. None of the second transport carriages can move outside of the transport section to which they are assigned. Directly in front of the reel changer there is provided a section for a second transport carriage, which second transport carriage can be moved into an upload position and into an unload position for the reel changer. By loading a first transport carriage, on which a new reel of material is deposited, onto a second transport carriage in this section at the reel changer, the new reel of material can be brought into a position that is necessary for uploading. By loading a wound-off reel of material onto a first transport carriage that has been moved to the unload position, by the use of the second transport carriage, the wound-off reel of material can be transported away.

JP 63-074852 A shows a railless transport carriage with a device for lifting reels of material. This transport carriage removes the reels of material from intermediate storage stations and transports the reels of material to a reel changer.

US 2003/0071162 A1, DE 196 26 866 A1, DE 295 16 155 U1 and the article "Zaun erhöht Sicherheit im Maschinenumfeld", Betriebstechnik Aktuell, Vogel Verlag GmbH, Würzburg, Vol. 39, No. 12, Dec. 1, 1998), p. 28, XP000792690, ISSN: 1434-8071" all describe security devices for transport and storage systems.

U.S. Pat. No. 5,076,751 A, DE 37 39 222 A1, U.S. Pat. No. 6,007,017 and DE 203 07 581 U1 disclose drives for transport systems for paper reels.

DE 41 35 001 A1, U.S. Pat. No. 4,537,368 A1 and JP62-157160 show devices for transporting reels of material from a storage area to a web-processing machine comprising multiple processing stations that are arranged one in front of another.

WO 03/080484 A1 describes a material transport system with a network of tracks and with transport carriages that can be moved on that network of tracks.

DE 39 10 444 A1 discloses a storage area for reels of paper. The paper reels are conveyed, via a reel carriage system, to a centrally arranged unpacking and splice-preparation station. After preparation, the reels of paper are reloaded onto the reel carriage system.

SUMMARY OF THE INVENTION

The object of the present invention is to provide devices for transporting reels of material.

The object is attained according to the invention by transporting the reels of material from a storage area, that includes a plurality of storage spaces, to a web-processing machine that has multiple web processing stations and a reel changer. A transport route for a primary transport carriage, which carries a reel of material, is provided in front of the reel changer. Storage spaces for reels of material can be arranged on both sides of this transport route. Each of the primary transport carriages can be assigned to a specific one of the plurality of storage spaces. The primary transport carriage supporting a reel can, in turn, be supported on a secondary transport carriage which moves between the storage area and the reel changer.

One benefit of the device in accordance with the present invention consists particularly in that the second transport carriage can also be moved along at least one transport route into a storage area in which new and/or completely or partially wound-off material reels can be stored in a plurality of storage spaces. In this manner, the existing second transport carriage, which is used for uploading the reels of material into the reel changer, can also be used to transport the reels of material out of a storage area or into a storage area. Furthermore, it is within the scope of the present invention for the second transport carriage to either convey new reels of material directly to the reel changer, or for the new reels of material to be first placed in the storage area and stored there intermediately until retrieval for later use. Above all, with the device in accordance with the present invention, an awkward transfer among the individual sections for the different second transport carriages can be avoided.

In accordance with one preferred embodiment of the present invention, the storage area is configured as an intermediate storage area, and particularly in the manner of a daily storage area. In other words the storage area, which can be approached with the second transport carriage, serves not for storage of the entire inventory of reels of material. Rather, it is intended only for the intermediate storage of a specific, and preferably smaller, number of reels of material near the reel changer. In addition, the reels of material in the intermediate storage area are intended to have already been unpacked and to have been prepared for the reel change, with the appropriate splices. If the storage area is configured in the manner of a daily storage area, then roughly the number of reels of material that are required for daily use by the web-processing machine are placed in intermediate storage in this daily storage area.

In principle, it is possible for the reels of material to be unloaded from the first transport carriage in the storage spaces of the storage area. However, this can cause damage to the reels of material. The storage spaces in the storage area are therefore preferably configured such that at least one first transport carriage can be placed in each such storage space. Unloaded first transport carriages can also be placed in the different storage spaces in the storage area, This provides a storage space for the first transport carriages which is relatively close to the web-processing machine.

The arrangement of the transport carriages in the various storage spaces of the storage area should preferably be non-specific. As a result, ultimately any first transport carriage can be placed in any storage space in the storage area. In this manner, a very high degree of flexibility and variability in the use of the storage area is realized.

The functional scope for utilization of the second transport carriage can be substantially increased. The first transport carriage can also be moved along a transport route into an unpacking station for unpacking the reels of material. In this manner, once new reels of material have been unpacked in the unpacking station, they can be retrieved and can be transported to subsequent processing stations.

Further, it is especially advantageous, in accordance with the present invention, if the first transport carriage can also be moved along a transport route to a splice preparation station. In this manner, once the splices have been applied to the leading edge of the web, the unpacked reels of material can be retrieved from the splice preparation station and can then be transferred to subsequent processing stations. In addition, system configurations are also within the scope of the present invention in which particularly the splice preparation station also serves simultaneously as the unpacking station. The first transport carriage retrieves the reels of material from this combined station and transfers them to subsequent processing stations.

In the interest of the efficient transport of material, the unpacking station and/or the splice preparation station should be positioned in front of, or before the storage spaces in the storage area, relative to the direction of transport of the reels of material. In this manner, in the transport of unpacked reels of material, or of reels of material that have been prepared with splices, in the storage area, only very short transport routes are necessary. The unpacked or splice-prepared reels of material can then be retrieved from the storage area at a later time via the second transport carriage, and can then be transferred to the reel changer.

In order to require the least possible amount of directional change, in the transport of the reels of material to the reel changer, it is particularly advantageous for the transport route in the storage area, on which the second transport carriage can be moved, to extend as a virtual extension of the direction of web travel in the web-processing machine.

As an alternative, or in addition to this, the transport route in the storage area can also extend parallel to the virtual extension of the direction of web travel in the web-processing machine. Very compact system configurations can be realized in this way.

The manner in which the storage spaces are configured in the storage area is essentially optional. According to one preferred embodiment of the present invention, branch lines, via which the storage spaces can be approached, extend off of the transport route in the storage area. In this manner, it is conceivable, for example, for the second transport carriage to transport the piggyback-loaded first transport carriages up to the branch line. The first transport carriage can then deposit the reel of material in the proper storage space by moving into the branch line. In this manner, the first transport carriage remains together with the corresponding reel of material in the storage space. The reel of material can be retrieved from the storage space and can be transported further by the first transport carriage being loaded onto the second transport carriage.

Depending on the configuration of the system of the present invention, storage spaces can be provided on both sides of the transport route. Alternatively, such storage spaces may be situated on only one side of the transport route.

For optimum functioning of the device of the present invention, the most precise possible positioning of the second transport carriage is of great importance. For example, if, during unloading of a first transport carriage, the second transport carriage is positioned in front of a branch line, precise positioning of the second transport carriage is essential. Otherwise, the first transport carriage cannot be moved into the branch line. Therefore, a position-sensing system should be provided along at least certain sections of the transport route. The second transport carriage can be precisely positioned using this position-sensing system.

For reasons of occupational safety, an area security system should be provided. Such an area security system will secure the boundaries of the storage area against unauthorized entry.

The area security system can be implemented by erecting a perimeter fence around the storage area. By using an existing area security system on the reel changer as a simultaneous area security system for the storage area, the expense required for implementing the area security system can be reduced.

To allow the transport of reels of material into or out of the storage area, a transfer channel can be provided in the area security system. In such a transfer channel area, the area security system should preferably operate without contact, such as, for example, by the use of photoelectric sensors or ultrasound sensors. By positioning such sensors at various levels, complex scanning patterns can be implemented. For example, reels of material can pass without difficulty into the transfer channel. However, an unauthorized exceeding of the sensor signals will trigger an alarm.

To prevent reels of material from being held too long in the storage area, the storage area should be operated according to the FIFO principle (first in, first out). This means that the reels of material, which are placed in the storage area first, are also transferred to the reel changer first.

BRIEF DESCRIPTION OF THE DRAWINGS

Preferred embodiments of the present invention are illustrated in the set of drawings and will be described in greater detail in what follows.

The drawings show.

DESCRIPTION OF THE PREFERRED EMBODIMENTS

Figure 1:
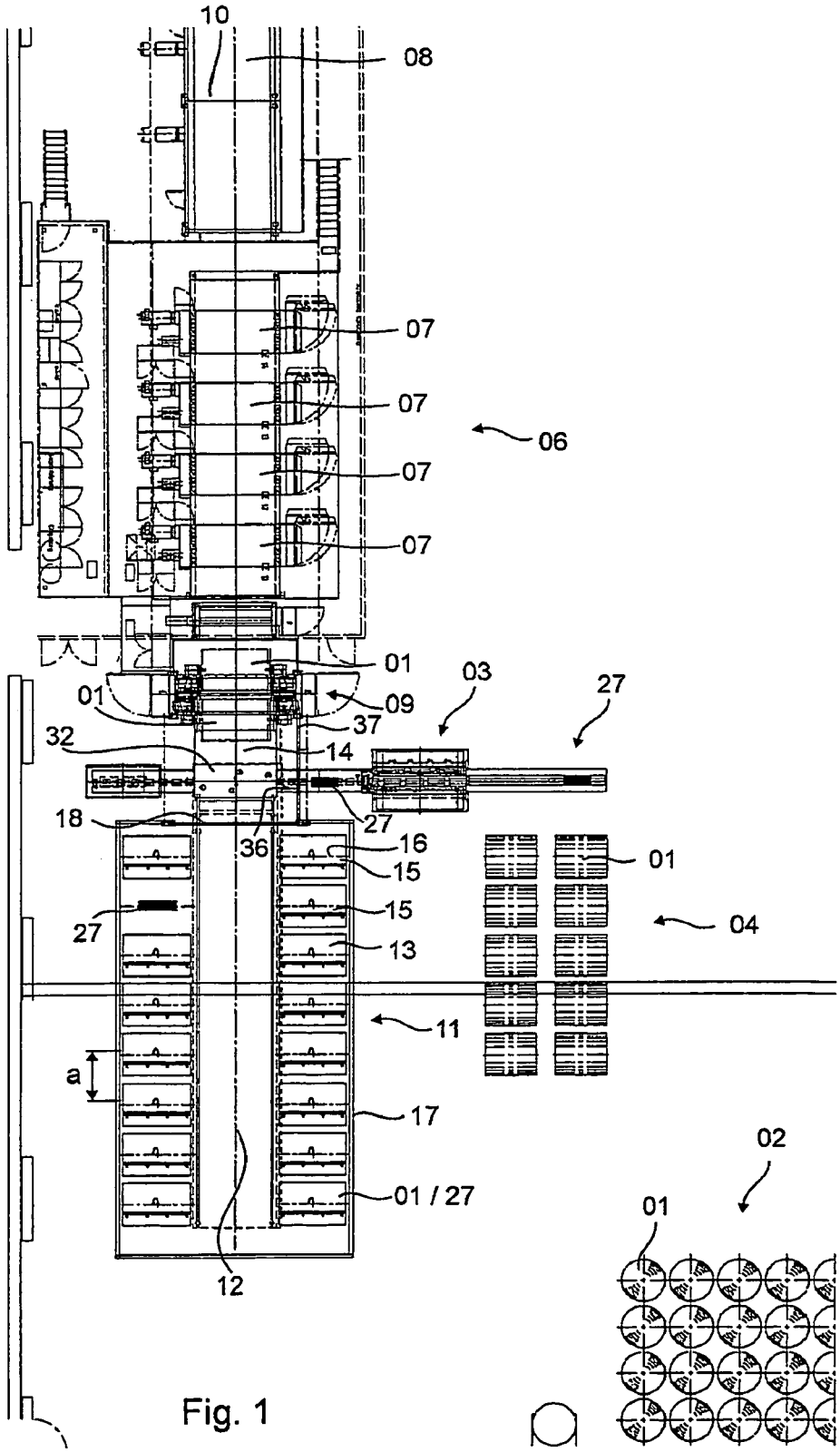
FIG. 1 a first preferred embodiment of a printing system with a device for transporting reels of material in accordance with the present invention.
Figure 5:
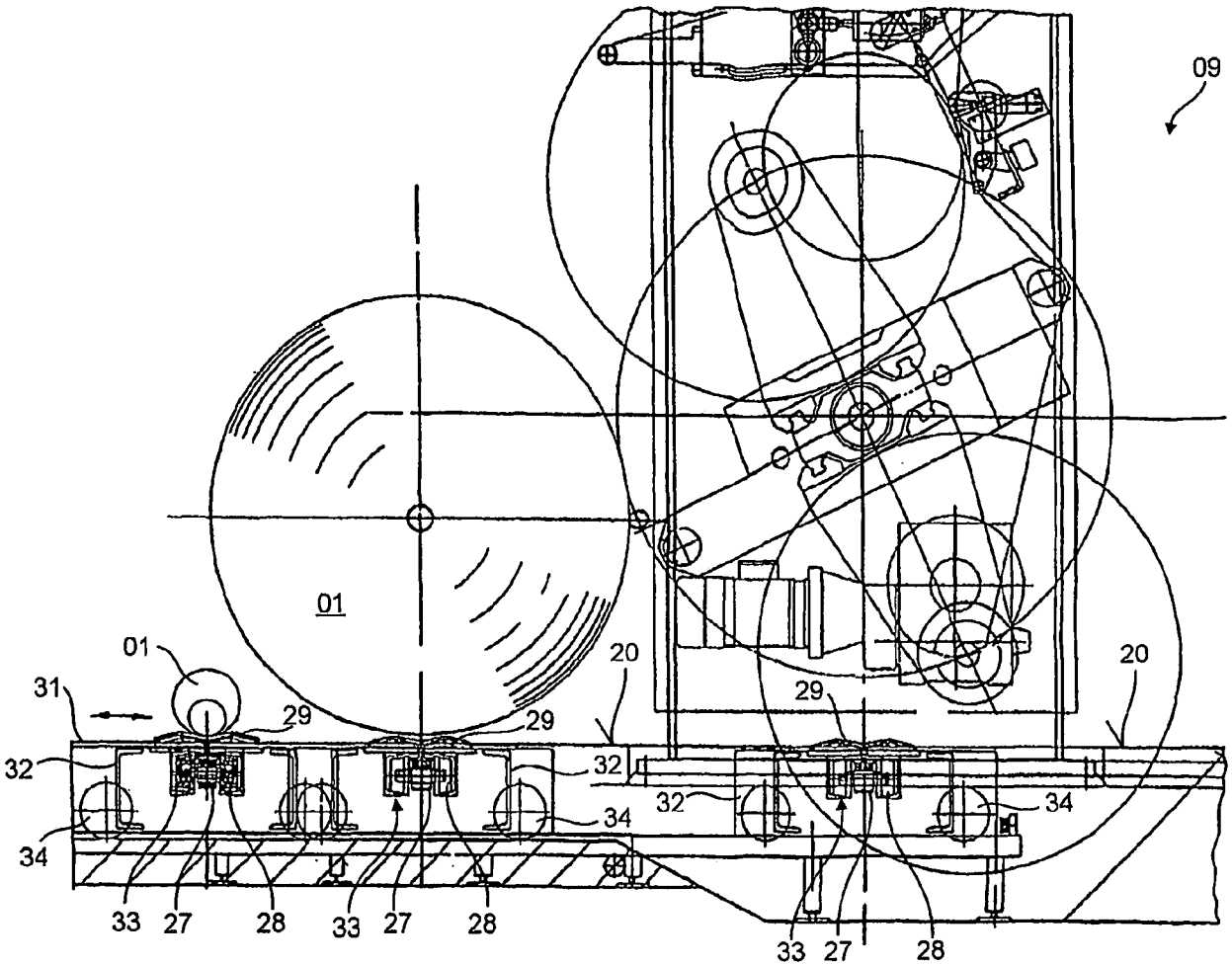
in FIG. 5 side elevation view of a reel changer for use with the printing systems shown in FIG. 1 through FIG. 4.
Figure 6:
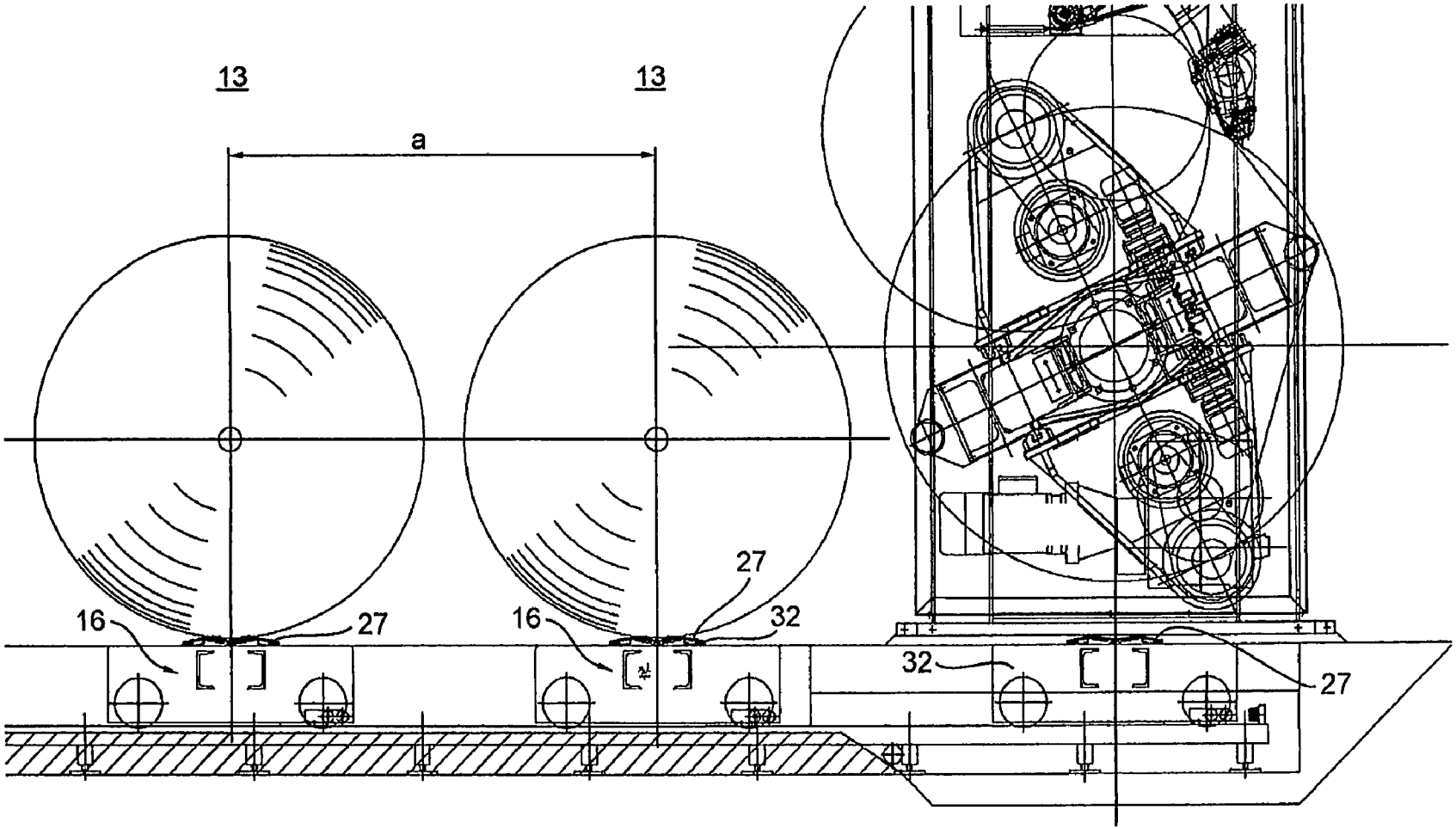
in FIG. 6 a side elevation view, partly in cross-section of a device for transporting reels of material, with a transport carriage in various positions in accordance with the present invention.

Referring initially to FIG. 1, there may be seen a schematic plan view of a printing system with a device for transporting reels of material 01 in accordance with the present invention. From a main storage area 02, packaged reels of material 01 are transported, via a suitable mode of transport, such as, for example, a clamping stacker truck, which is not specifically shown, to the area of a reel unpacking station 03, where they are deposited on a reel receiver 04. In the reel unpacking station 03, the reels of material 01 are manually rolled onto a first transport carriage 27. For this purpose, the first transport carriage 27 has a suitable trough on its upper surface as seen in FIGS. 5 and 6, which trough is configured to hold the reels of material 01 securely in place. By pressing a button, the reel of material 01 is transported to the center of the unpacking station 03, is centered, and then is manually unpacked. After the reel of material has been unpacked, the operators also apply the necessary splices 15 to the leading edge of the web of the reel of material 01. The unpacking station 03 thus serves, at the same time, as a splice preparation station 03.

As seen in FIGS. 1 to 4, there is provided a web-processing machine, generally at 06, which receives the web from the reel of material 01. The web-processing machine 06 is configured in the manner of a web-fed rotary printing press 06, in which a web of printing material passes through a plurality, and typically four printing couples 07 in sequence. In this web-processing machine or printing press 06, the web of printing material can, for example, be printed in four colors and on both sides, after which it is dried in a dryer 08. To supply the printing couples 07 with the web of printing material, a reel changer 09, in which two reels of material 01 can be mounted, is positioned in front of, or before, in a direction of web travel, the web-processing machine 06. With the reel changer 09, a flying reel change can be implemented without machine down time.

The web-fed rotary printing press is particularly configured as a gravure printing machine or as an offset printing machine, such as, for example, a commercial printing machine. Preferably, for example, the floor of the shop, the storage area and/or the reel changer and/or the printing couples are arranged, for example, one behind another in a single horizontal plane 20 or level, relative to the direction of web travel, as depicted in FIG. 5.

Figure 2:
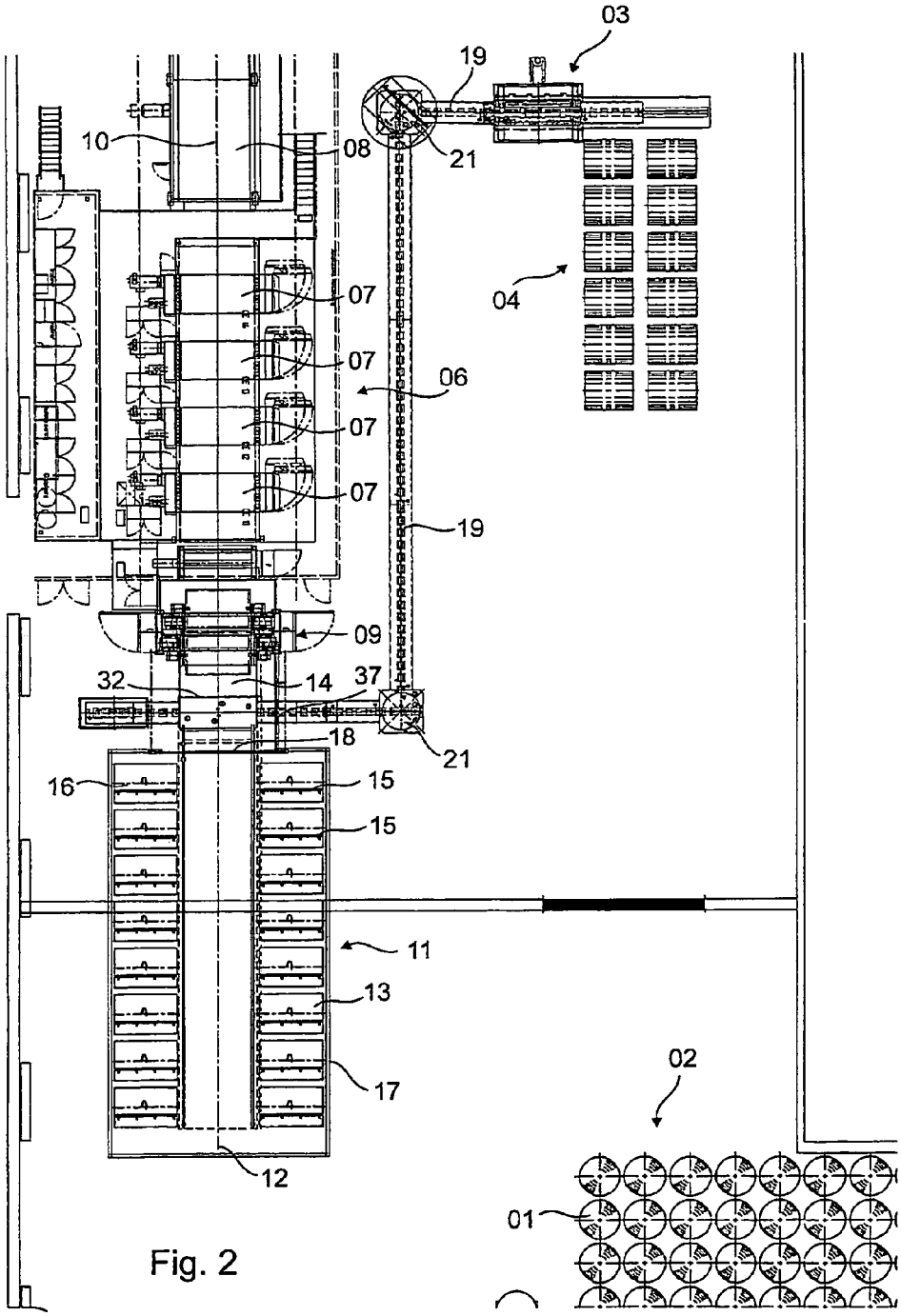
in FIG. 2 a second preferred embodiment of a printing system with a device for transporting reels of material in accordance with the present invention.

In the immediate vicinity of the reel changer 09, a storage area 11 is provided, as seen in FIGS. 1 and 2 which storage area 11 is configured as an intermediate storage area that is usable for storage of the reels of material 01 which are required for one day of operation of the web-processing machine 06. On each side of a transport route 12, which is also shown in FIGS. 1 and 2, eight storage spaces 13 are provided in the storage area 11. A first transport carriage 27, with a reel of material 01 deposited thereon, can be positioned in each such storage space 13.

Figure 7:
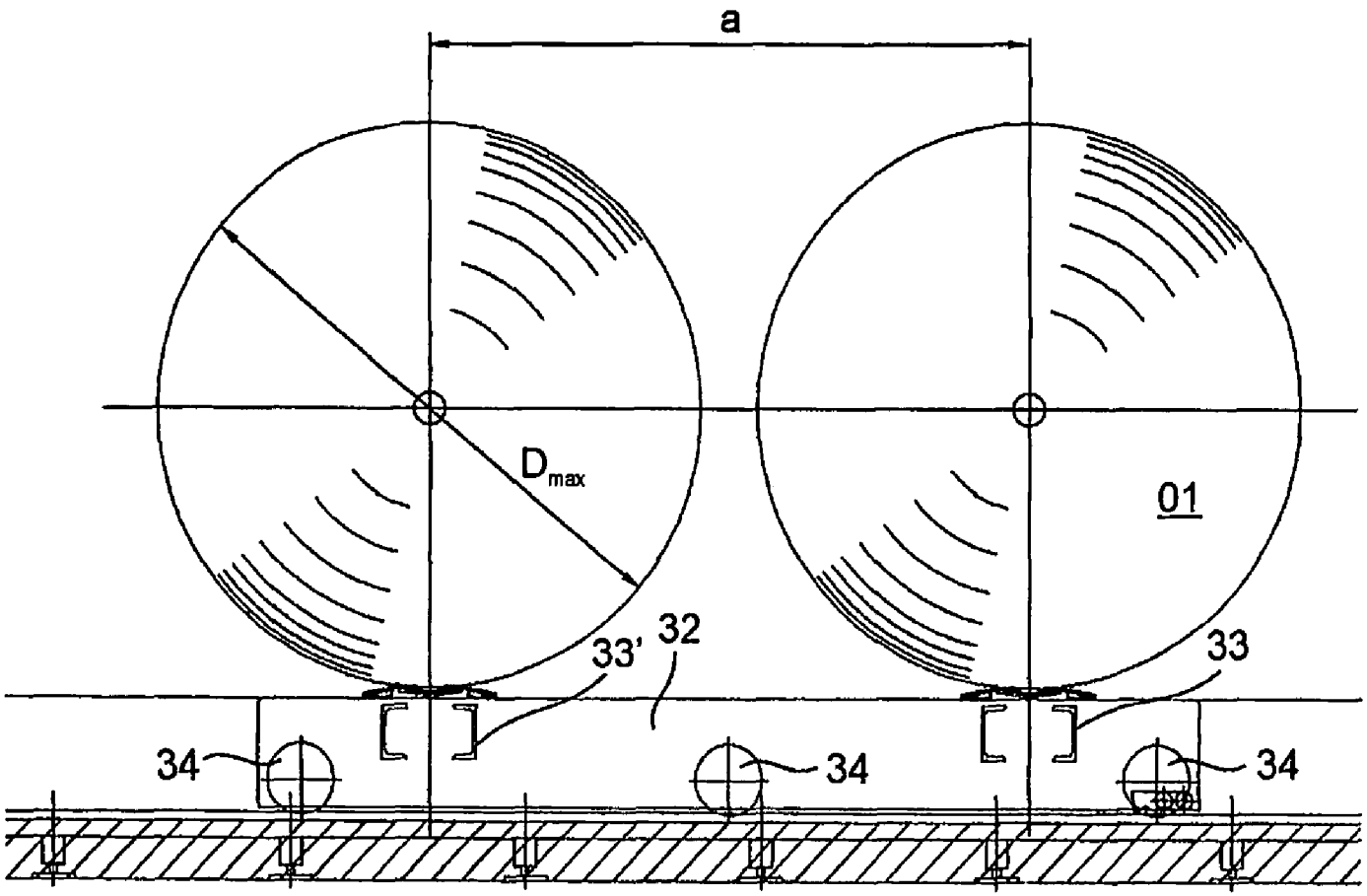
in FIG. 7 a second preferred embodiment of the transport carriage, and configured to hold two reels of material; and in FIG. 8 a further preferred embodiment of a printing system with two daily storage areas, in accordance with the present invention.
Figure 8:
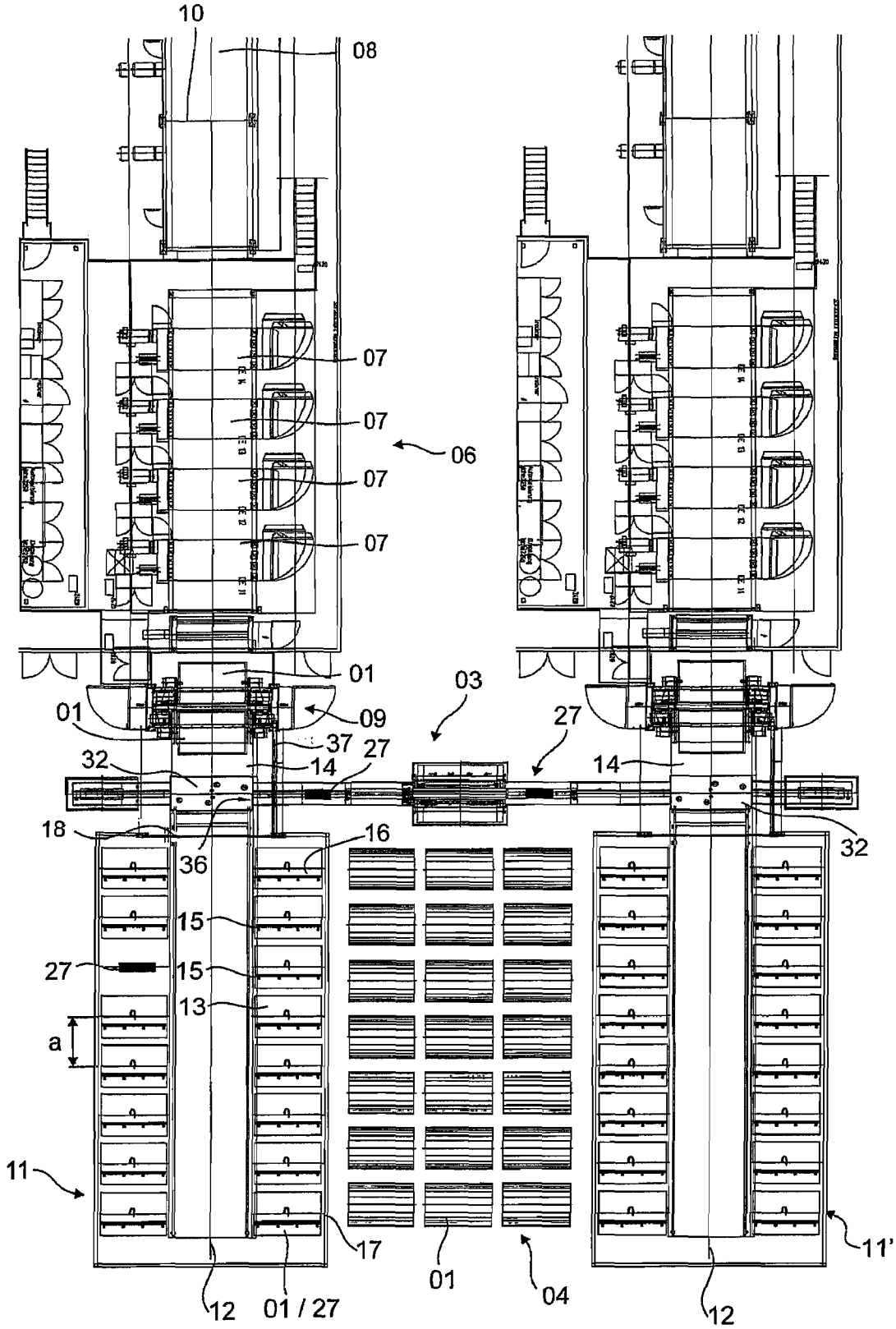

Once the splices 15 have been prepared on the reel of material 01, another first transport carriage 27 takes over the reel of material 01 at the unpacking station, with the reel of material 01 in its raised position, and travels with it to the point of transfer onto a second transport carriage 32 which is depicted schematically in FIG. 1 and is shown more fully in FIGS. 5, 6 and 7. There, the first transport carriage 27 is loaded piggyback onto the second transport carriage 32. By moving the second transport carriage 32, the splice-prepared reel of material 01 can optionally be conveyed via a transport route 14 directly to the reel changer 09 or via the transport route 12 to the storage area 11. The decision as to whether the reel of material 01 will be transferred from the unpacking station 03 directly to the reel changer 09 or into the storage area 11 is made under the control of a material supply system which is not specifically shown.

If the splice-prepared reel of material 01 is to be conveyed to the storage area 11, the second or secondary transport carriage 32, with the first or primary transport carriage 27 loaded piggyback onto it, and with the reel of material 01 loaded onto the primary transport carriage 27, travels via the transport route 12 into the storage area 11 until it reaches an empty storage space 13. The second transport carriage 32 is then positioned in front of the empty storage space 13 such that the first or primary transport carriage 27 can be pushed into the branch line 16 of the specific empty storage space 13. The second or secondary transport carriage 32 then leaves the storage area 11, again via the transport route 12. The secondary transport carriage 32 can optionally also carry another first transport carriage 27 out of the storage area 11 as it departs. When a new reel of material 01 is required on the reel changer 09, a reel of material 01 that has just been unpacked may be conveyed from the unpacking station 03, via the transport route 14, to the reel changer 09. Alternatively, a reel of material 01 that is already provided with splices 15 is conveyed from the storage area 11 to the reel changer 09.

The transport route 12 extends through the storage area 11 in a virtual extension of the direction of web travel through the web-processing machine 06. Accordingly, in the transport of a reel of material 01 out of the storage area 11 and to the reel changer 09, no change in direction of the second or secondary transport carriage 32 is necessary.

The storage area 11 is protected against unauthorized entry. On three sides of the storage area 11, unauthorized entry security is provided by a secured area, and especially by a perimeter fence. On a side of the storage area 11 that faces the reel changer 09, a transfer channel 18 is provided in the area security system 37 for the reel changer 09. In the area of the transfer channel 18, the area security system 37 is accomplished by the use of photoelectric beams or of sensors, such as, for example, laser sensors, which function without contact.

The storage or the retrieval of the reels of material 01 in the storage area 11 is operated according to the FIFO principle, in order to prevent the reels of material 01 from being intermediately stored for too long a period in the storage area 11, which lengthy storage would cause the splices 15 to become unusable.

In FIG. 2, there is shown a schematic depiction of a second system in accordance with the present invention. This second embodiment differs from the first embodiment which is shown in FIG. 1 in that between the unpacking station 03 and the reel changer 09 or the storage area 11 there is provided an additional transport route 19. The second or secondary transport carriage 32 transports the piggyback-loaded first or primary transport carriage 27 and the reel of material 01 deposited thereon to the reel changer 09 or to the storage area 11 along this additional transport route 19. Two rotating platforms 21 are included in the transport route 19, to permit a change of direction of the first transport carriage 27 between the unpacking station 03 and the storage area 11 or the reel changer 09.

Figure 3:
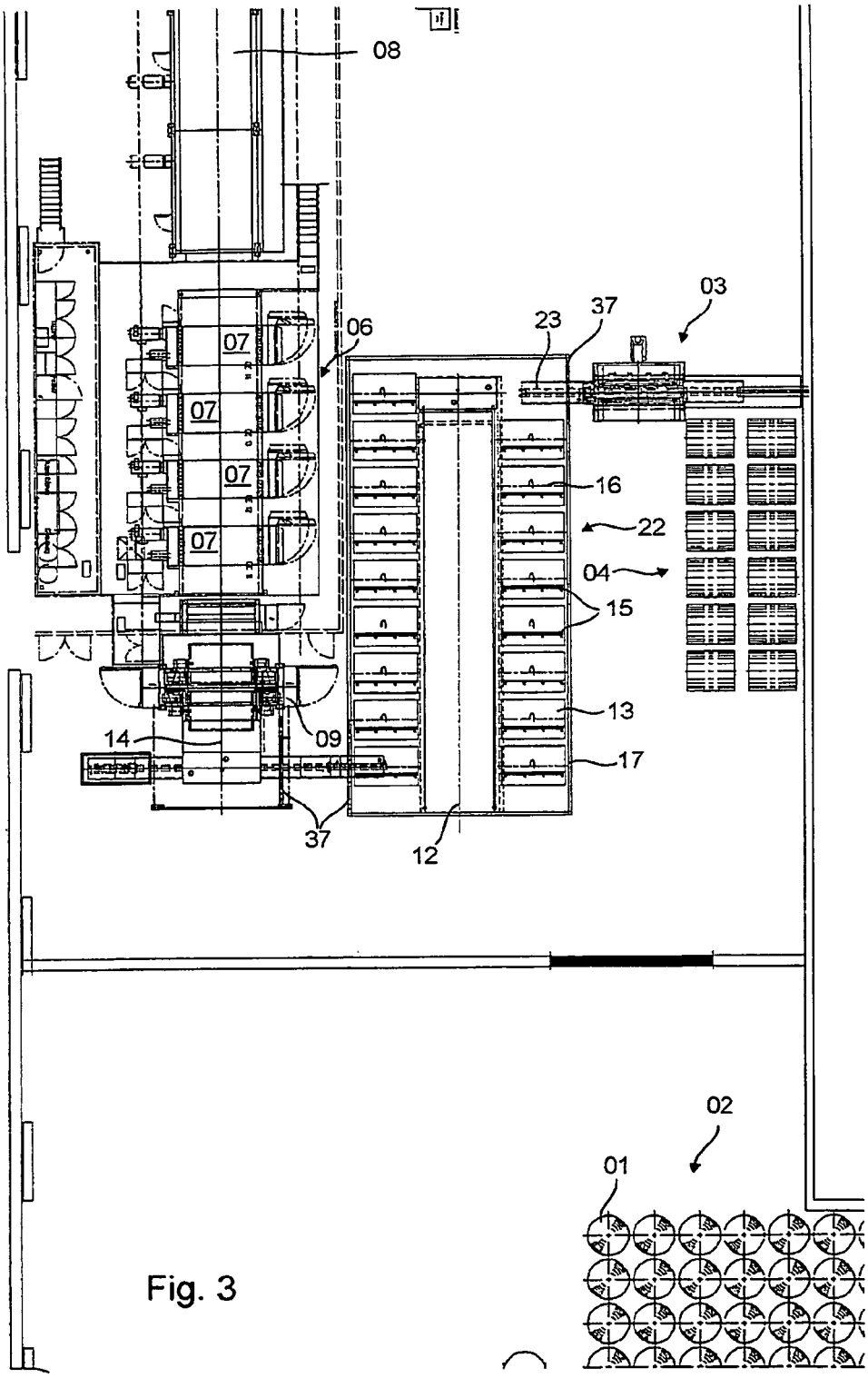
in FIG. 3 a third preferred embodiment of a printing system with a device for transporting reels of material in accordance with the present invention.

In the schematic depiction of a third preferred embodiment of a system in accordance with the present invention, as shown in FIG. 3, a storage area 22 that serves as an intermediate storage area is provided. A transport route 23 extends through the storage area 22, and runs perpendicular to the direction of web travel in the web-processing machine 06. During the transport of a reel of material 01 from the unpacking station 03 to the reel changer 09, the first transport carriage 27 passes through the entire storage area 22, along the transport route 23. Based upon requirements set forth by the control system of the material supply system, a splice-prepared reel of material 01 in the unpacking station 03 is either first placed in intermediate storage in the storage area 22 or is conveyed directly to the reel changer 09. Furthermore, a reel of material 01 that has already been prepared with splices 15 can be retrieved as needed from the storage area 22 and can be conveyed to the reel changer 09. In addition, the storage spaces 13 in the storage area 22 are located on both sides of the transport route 12, and thus are parallel to the web-processing machine 06, resulting in a highly compact system configuration.

Figure 4:
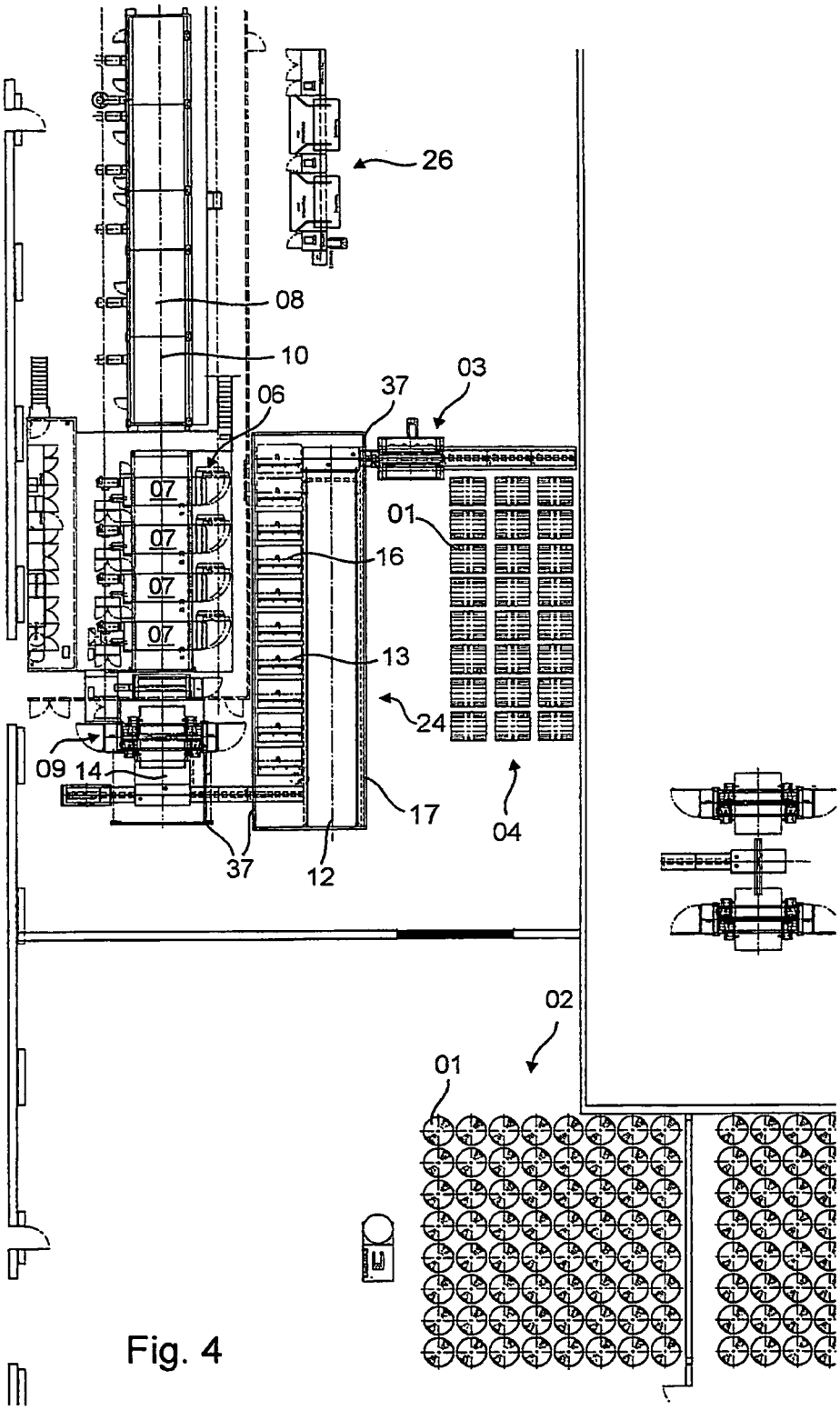
in FIG. 4 a fourth preferred embodiment of a printing system with a device for transporting reels of material in accordance with the present invention.

In FIG. 4, a fourth preferred embodiment of the present invention is illustrated, and which corresponds, to a large extent, to the system shown in FIG. 3. However, in contrast to the system shown in FIG. 3, in the storage area 24, storage spaces 13 are provided on only the left side of the transport route 12. Overall, an even more compact system configuration is enabled. The system is controlled via a control center 26.

In FIG. 5, a reel changer 09 is shown in side elevation view and partly in cross-section. First transport carriages 27 are used to transport new reels of material 01, and wound-off reels of material 01 to and from the reel changer 09. Primary transport carriages 27 of this system are, for example, rail-guided. The transport carriage 27 has four wheels or rollers 28 that travel on rails. To actuate the transport carriages 27, for example, a drag conveyor that extends underneath the floor can be provided, which drag conveyor is structured, for example, as a continuous chain. The transport carriage 27 is attached to this chain at least part of the time. A trough-shaped tray 29, which is configured to accommodate the reels of material 01, is attached to a support frame of the transport carriage 27. The trough-shaped tray 29, which serves as a receptacle for the reels of material 01, protrudes from the floor 31 of the storage room. The first transport carriage 27 itself proceeds recessed beneath the floor 31 of the storage room as may be seen most clearly in FIG. 5.

In each of the branch lines 16 of the storage spaces 13 of the intermediate storage areas 11, 22 or 24, segments of track are provided, in which track segments the wheels or rollers 28 of the first transport carriages 27 can run. In addition, in each storage space 13 a separate chain drive is provided. Preferably, at least the majority of the storage spaces 13 are each equipped with a separate chain drive.

The storage spaces 13 or branch lines 16 each hold a reel of material 01 or a transport carriage 27. However, they can also accommodate precisely 2, or more reels of material 01.

The second or secondary transport carriages 32 are used to convey the first or primary transport carriages 27 along the transport routes 12 and 14. A support frame of each second transport carriage 32 has a short segment of track 33, in which short track segment 33 the wheels or rollers 28 of a first transport carriage 27 can run. The second transport carriages 32 are also arranged underneath the floor and are each provided with four of their own wheels or rollers 34 that are guided on suitably configured rails. Chain drives can also be used to convey the second transport carriages 32.

In an alternative embodiment, a single second transport carriage 32 can also have two segments of track 33; 33', as depicted in FIG. 7. In this embodiment, a spacing distance "a" between the two segments of track 33; 33' is greater than a maximum diameter $D_{max}$ of any one of the reels of material 01 to be transported. Preferably, the distance "a" between the two segments of track 33; 33' of the secondary transport carriage 32 is equal to a distance "a" between the segments of track 33; 33' of the branch lines 16 of the storage spaces 13, as seen in FIG. 1.

At least one of the primary transport carriages 27 can carry an adapter, which is configured specifically to accommodate partially used reels, as seen in FIG. 5.

The longitudinal direction of the intermediate storage area, and the direction of web travel in the web-processing machine extend in essentially the same direction.

There are no rotating platforms for the transport carriages 27 arranged between the storage spaces 13 and the reel changer 09. Also, no rotating platforms are arranged between the storage spaces 13 and the splice preparation station 03 for the transport carriages 27.

At least one printing couple 07, the reel changer 09 and the storage spaces 13 are arranged nearly in a common plane 20, as depicted in FIG. 5. An arrangement of all of the printing couples 07 in a single common plane is advantageous. The web-processing machine further has a single reel changer. The transport route of the second or secondary transport carriage 32, and the longitudinal axis 10 of a dryer 08 of the web-processing machine are arranged such that they lie in alignment. Alternatively, they may be arranged in a parallel offset arrangement.

Lower edges of the relevant side frames of the printing couples 07 serve as the point of reference for the printing couples 07 and the reel changer 09. A mount of the transport carriages 27 serves as the point of reference for the storage spaces 13. The common plane 20 in this configuration is the floor of the building.

The device for transporting reels of material operates on the basis of the specific reel data recorded in the transport or preparation process. This specific reel data may be, for example, the bar code and/or the reel width and/or the reel status and/or the weights (gross weight, net weight 1, net weight 2) and/or the splice time and/or the run length, etc. This encompasses, for example, the data recording and/or data management and/or data allocation in the overall process, i.e. from the receipt of the unprepared reels up to disposal of the sheathing or reel core.

The data is maintained and managed in the relevant process steps. In connection with this, for example, the evaluation and the storage of this data, for the purpose of further utilization, can be implemented via a suitable management/support system. It is further possible to use the reel data, that are recorded via the reel changer/changers during and following the winding-off process, for entry into the specific record of information with respect to the reel and its allocation.

Furthermore, the device in accordance with the present invention is capable of handling partial reels or reels returned from the production process, and of managing them accordingly in the transport, preparation and data management processes. This includes all ancillary processes associated therewith. One component of this is the processes associated with the transport of partial reels, such as, for example, via adapters. The management of the adapters, with and without reels and of all processes necessary to accomplish this, can also be integrated, for example.

A further characterizing feature of a device in accordance with the present invention involves the use of multiple reel carriages for each storage area position. It also involves all the processes which are necessary to accomplish this.

One preferred embodiment, which is not specifically depicted also involves the use of a transfer table with multiple rail lines, which enables further optimizations of the device.

Another possible characterizing feature of a device in accordance with the present invention is the transport of the sleeve or core container, and its data content, to specific, such as, for example, freely selectable, positions in the storage area, or to other possible positions in the device. Further data transfers to the management system or to other evaluation units in the machine or to a production preparation system can also be included in this.

While preferred embodiments of devices for transporting reels of material, in accordance with the present invention, have been set forth fully and completely hereinabove, it will be apparent to one of skill in the art that various changes in, for example, the specific structure of the printing couples and of the reel changers, the specific splices placed on the web leading ends, and the like could be made without departing from the true spirit and scope of the present invention which is accordingly to be limited only by the appended claims.

What is claimed is:

1. A device for transporting reels of material comprising:

a ree receiver adapted to receive and to store full reels of material;

a reel preparation station adapted to receive ones of said full reels of material from said reel receiver and to prepare said full reels of material to form prepared reels of material;

first and second laterally spaced web-processing machines, each including at least one web-processing station and a reel changer having an uploading and unloading position, said at least one web-processing station and said reel changer in each of said first and second laterally spaced web-processing machine being arranged sequentially in a longitudinal direction of web travel through the respective ones of said web-processing machines, said reel preparation station being a shared reel preparation station positioned between said first and second web-processing machines and being usable to provide said prepared reels of material selectively to both of said first and second laterally spaced web-processing machines from said reel receiver;

a separate intermediate reel storage area for each one of said first and second laterally spaced web-processing machines with each said intermediate web storage are being adapted to receive and to store a plurality of said prepared reels of material received from asaid shared reel preparation station, each of said prepared reels of material having a reel width in a axial direction of each said reel of material and a reel diameter;

a plurality of primary transport carriages, each said primary transport carriage being adapted to support one of said full reels of material in said shared reel preparation station and during movement of each one of said prepared full reels of material directly from said shared reel preparation station to a selected one of said separate intermediate reel storage areas and also in said selected intermediate reel storage area associated with each one of said first and second laterally spaced web-processing machines;

a single, straight transport route extending directly from said intermediate reel storage area for each one of said and second laterally spaced web-processing machines to each said reel changer in each said respective web-processing machine, each said single, straight transport route being aligned with said longitudinal direction of web travel through said associated one of said laterally spaced first and second web-processing machines;

at least one secondary transport carriage supported for movement along each said single, straight transport route for each of said first and second web-processing machines, said at least one secondary transport carriage for each said single, straight transport route being adapted to receive one of said primary transport carriages and its supported one of said prepared reels of material, directly from said shared reel preparation station and to transport each said primary transport carriage and its supported one of said prepared reels of material directly to said separate one fo said intermediate reel storage areas for each of said first and second web-processing machines, from said shared reel preparation station and along said single, straight transport route of each of said first and second web-processing machines and further being adapted to transport each said primary transport carriage, and its supported one of said prepared reels of material, directly between said intermediate reel storage area, along said single, straight transpor route to said uploading and unloading position of said reel changer for each of said first and second web-processing machines;

a plurality of reel storage spaces in each said intermediate reel storage area for each of said first and second laterally spaced web-processing machines, each of said plurality of reel storage spaces for each of said first and second laterally spaced web-processing machines including a first group of reel storage spaces located ona first side of said single, straight transport route for each of said first and second web-processing machines and a second group of said plurality of reel storage spaces located on a second, opposite side of said single, straight transport route, at least two of said reel storage spaces in each of said first and second groups of said reel storage spaces for each of said intermediate storage areas being aligned directly one in front of the other in said longitudinal direct of each said web processing machine, said at least two longitudinal aligned ones of said plurality of reel storage spaces in each of said first and second groups of reel storage spaces in each of said intermediate storage areas each having a storage space width, in a direction transverse to said longitudinal direction of web travel, to each store at least one of said prepared reels of material transported directly to each said reel storage space from said reel preparation station and to be transported directly from each said reel storage space to said reel changer of a respective one of said first and second web-processing machines by one of said primary transport carts loaded onto said secondary transport carriage for each said web processing machine;

a separate branch transport line eitending perpendicular from said single, straight transport route for each of said first and second laterally spaced web-processing machines and into each of said plurality of reel storage spaces in each of said first and second groups of each of said intermediate reel storage areas, a spacing between adjacent one of said branch transport linesin said aligned reel storage spaces in each of said first and second groups in each of said intermediate reel storage areas being greater than said reel diameter, at least two of said adjacent ones of said reel storage spaces in each of said first and second groups in each said intermediate reel storage area being adapted to each store said at least one of said prepared reels of material received from said reel preparation station and each supported on a separate one of said primary transport carriages; and a primary transport carriage drive means in at least a majority of said at least two of said reel storage spaces in each of said first or second groups of said reel storage saces in each of said intermediate reel storage areas.

2. The device of claim 1 wherein each of said primary transport carriages is assigned to a fixed one of said plurality of reel storage spaces in each said separate intermediate reel storage area.

3. The device of claim 1 wherein two of said primary transport carriages can be supported on said at least one secondary transport carriage in each of said first and second web-processing machine.

4. The device of claim 1 wherein said plurality of reel storage spaces in each of said first and second web-processing machines are arranged parallel to said direction of web travel and before each said web-processing machine.

5. The device of claim 1 wherein all of said reels of material are prepared with splices.

6. The device of claim 1 wherein one of said primary transport carriages is positionable in each said reel storage space.

7. The device of claim 6 wherein any ones of said primary transport carriages is reusable in any ones of said plurality of reel storage spaces.

8. The device of claim 1 further including a reel of material unpacking station in said reel preparation station and wherein each of said of primary transport carriages can be moved to said unpacking station.

9. The device of claim 8 further including a splice preparation station in said reel preparation station and wherein each of said primary transport carriages can be moved to said splice preparation station.

10. The device of claim 9 wherein said splice preparation station includes said unpacking station.

11. The device of claim 1 wherein each said transport route is a virtual extension of each said direction of web travel in each of said first and second web-processing machines.

12. The device of claim 1 further including a position-sensing system provided along at least a portion of each said transport route and usable for precise positioning of each said at least one secondary transport carriage.

13. The device of claim 1 further including a secured area positioned around each said immediate reel storage area.

14. The device of claim 13 further including a perimeter fence defining each said secured area.

15. The device of claim 13 further including a reel changer area security system for each said reel changer and forming said secured area.

16. The device of claim 13 wherein each said secured area includes at least one transfer channel.

17. The device of claim 16 further including one of photoelectric beams and ultrasound sensors in said secured area at each said transfer channel.

18. The device of claim 17 wherein said one of said photoelectric beams and ultrasound sensors are arranged at different levels.

19. The device of claim 1 further including a plurality of said web-processing stations arranged one in front of the other in said direction of web travel in each of said first and second web-processing machines.

20. The device of claim 1 wherein each said at least one web-processing station in each of said first and second web-processing machines is a printing couple of a rotary printing press.

21. The device of claim 20 wherein said printing couple defines a horizontal web path.

22. The device of claim 20 wherein said at least one printing couple, said reel changer and said intermediate reel storage area in each of said first and second laterally spaced web-processing machines are in a common plane.

23. The device of claim 22 including a plurality of printing couples in each said first and second laterally spaced web-processing machine and all on said common plane.

24. The device of claim 1 wherein each said separate intermediate reel storage area in each of said first and second web-processing machines is a FIFO storage area.

25. The device of claim 1 further including a web-processing machine control center adjacent each said separate intermediate reel storage area.

26. The device of claim 1 further including wheels on each of said plurality of primary transport carriages.

27. The device of claim 26 further including a primary transport carriage chain drive.

28. The device of claim 1 further including wheels on each said secondary transport carriage and rails defining said, single, straight transport route in each of said first and second web-processing machines and adapted to receive said wheels.

29. The device of claim 28 further including primary transport carriage receiving rails on each said secondary transport carriage.

30. The device of claim 29 wherein said primary transport carriage receiving rails on each said secondary transport carriage are spaced at a distance from each other.

31. The device of claim 1 wherein each of said plurality of reel storage spaces in each of said separate intermediate reel storage areas accommodates at least a single one of said primary transport carriages.

32. The device of claim 31 wherein all of said plurality of reel storage spaces in each said separate intermediate reel storage area accommodate at least two of said primary transport carriages.

33. The device of claim 1 wherein others of said plurality of reel storage spaces in each of said separate intermediate reel storage areas accommodate at least two of said primary transport carriages.

34. The device of claim 1 wherein each of said primary transport carriages is adapted to accommodate a partial reel of material.

35. The device of claim 1 wherein spacings of all of said reel storage spaces are greater than said reel diameter.

36. The device of claim 1 wherein all of said reel storage spaces in each of said separate intermediate reel storage areas are each sized to store two of said prepared reels of material.

37. The device of claim 1 wherein at least three of said reel storage spaces in each of said separate intermediate reel storage areas are arranged, in each of said first and second groups of reel storage spaces, on both of said first and second sides of said single, straight transport route in each of said first and second web-processing machines.

38. The device of claim 1 wherein at least two adjacent ones of said reel storage spaces in each of said separate intermediate reel storage areas are adapted to store new ones of said prepared reels of material.

39. The device of claim 38 wherein at least a majority of said reel storage spaces in each of said separate intermediate reel storage areas are adapted to store said new ones of said prepared reels of material.

40. The device of claim 39 wherein all of said reel storage spaces in each of said separate intermediate reel storage areas are adapted to store said new ones of said prepared reels of material.

41. The device of claim 1 wherein each said first and second laterally spaced web processing machine has a single reel changer.

42. The device of claim 1 further including a web dryer having a web dryer longitudinal axis in each said first and second laterally spaced web-processing machine, and wherein said secondary support carriage single, straight transport route in each of said first and second laterally spaced web-processing machine is aligned with said web dryer longitudinal axis.

43. The device of claim 1 further including an under floor primary transport carriage conveyance system in each of said majority of said reel storage spaces and forming said primary transport carriage drive means.

44. The device of claim 43 wherein each said under floor transport carriage conveyance system has a revolving means of propulsion.

45. The device of claim 44 wherein said revolving means of propulsion is a chain.

46. The device of claim 1 further including a drive for each of said plurality of primary transport carriages.

47. The device of claim 1 wherein said at least one secondary transport carriage in each said first and second laterally spaced web-processing machine has a separate drive.

48. The device of claim 47 wherein said at least one secondary transport carriage separate drive in each said first and second laterally spaced web-processing machine is independent of said primary transport carriage drive means.

* * * * *

UNITED STATES PATENT AND TRADEMARK OFFICE

CERTIFICATE OF CORRECTION

PATENT NO. : 8,011,871 B2
APPLICATION NO. : 10/590390
DATED : September 6, 2011
INVENTOR(S) : Lehrieder et al.

It is certified that error appears in the above-identified patent and that said Letters Patent is hereby corrected as shown below:

Column 9, in claim 1, line 30, after “a”, “ree” should be “reel”;

Line 41, before “being”, “machine” should be --machines--;

Line 52, after “storage”, “are” should be --area--;

Line 54, after “from”, “asaid” should be --said--;

Column 10, in claim 1, line 2, after “said”, insert --first--;

Line 19, after “one”, change “fo” to --of--;

Line 27, after “straight”, change “transpor” to --transport--;

Line 36, after “located”, change “ona” to --on a--;

Line 45, before “of”, change “direct” to --direction--;

Line 59, after “line” change “eitending” to --extending--;

Line 65, after “adjacent” change “one” to --ones--; and after “transport” change “linesin” to --lines in--.

Column 11, in claim 1, line 10, after “storage” change “saces” to --spaces--.

Column 12, in claim 28, line 25, after “said” (second occurrence), delete the “,”.

Signed and Sealed this
Eighth Day of November, 2011

David J. Kappos

David J. Kappos
*Director of the United States Patent and Trademark Office*